US012123170B2

(12) United States Patent
Moriki et al.

(10) Patent No.: US 12,123,170 B2
(45) Date of Patent: Oct. 22, 2024

(54) INTRUSION MONITORING CONTROL SYSTEM AND WORK MACHINE

(71) Applicant: HITACHI CONSTRUCTION MACHINERY CO., LTD., Tokyo (JP)

(72) Inventors: Hidekazu Moriki, Tokyo (JP); Takuya Naka, Tokyo (JP); Shinya Imura, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 279 days.

(21) Appl. No.: 17/763,730

(22) PCT Filed: Sep. 30, 2020

(86) PCT No.: PCT/JP2020/037280
§ 371 (c)(1),
(2) Date: Mar. 25, 2022

(87) PCT Pub. No.: WO2021/066057
PCT Pub. Date: Apr. 8, 2021

(65) Prior Publication Data

US 2022/0316184 A1 Oct. 6, 2022

(30) Foreign Application Priority Data

Oct. 4, 2019 (JP) ..... 2019-184054

(51) Int. Cl.
*E02F 9/20* (2006.01)
*E02F 9/24* (2006.01)
*E02F 9/26* (2006.01)

(52) U.S. Cl.
CPC ..... *E02F 9/2033* (2013.01); *E02F 9/24* (2013.01); *E02F 9/262* (2013.01)

(58) Field of Classification Search
CPC ..... E02F 9/2033; E02F 9/24; E02F 9/262
(Continued)

(56) References Cited

U.S. PATENT DOCUMENTS

2008/0122604 A1* 5/2008 Hattori ..... B62D 15/0275 340/441
2018/0274206 A1 9/2018 Kozui et al.
2019/0194913 A1 6/2019 Petrany et al.

FOREIGN PATENT DOCUMENTS

EP 2716821 A1 4/2014
JP 09-125466 A 5/1997
(Continued)

OTHER PUBLICATIONS

English Translation for JP-2016194481-A (Year: 2024).*
(Continued)

*Primary Examiner* — Mahmoud S Ismail
(74) *Attorney, Agent, or Firm* — MATTINGLY & MALUR, PC

(57) ABSTRACT

There are provided: a monitoring apparatus that detects an obstacle located around a hydraulic excavator, and outputs obstacle information; and a controller that calculates an operation limiting command for limiting operation of the hydraulic excavator in accordance with an intrusion prohibited area set on the basis of a result of comparison between a movable range of the hydraulic excavator and a monitoring range of the monitoring apparatus and in accordance with the obstacle information from the monitoring apparatus. Thereby, it is possible to appropriately set an intrusion prohibited area, and reduce detection failures and detection errors.

3 Claims, 14 Drawing Sheets

(58) Field of Classification Search
USPC ..... 701/50
See application file for complete search history.

(56) References Cited

FOREIGN PATENT DOCUMENTS

| | | | | |
|---|---|---|---|---|
| JP | 2003-105807 | A | | 4/2003 |
| JP | 2012-203677 | A | | 10/2012 |
| JP | 2016194481 | A | * | 11/2016 |
| JP | 2018-159194 | A | | 10/2018 |
| JP | 2020-173524 | A | | 10/2020 |

OTHER PUBLICATIONS

Extended European Search Report received in corresponding European Application No. 20870529.3 dated Aug. 14, 2023.
International Search Report of PCT/JP2020/037280 dated Dec. 22, 2020.
International Preliminary Report on Patentability received in corresponding International Application No. PCT/JP2020/037280 dated Apr. 14, 2022.

* cited by examiner

INTRUSION MONITORING CONTROL SYSTEM AND WORK MACHINE

TECHNICAL FIELD

The present invention relates to an intrusion monitoring control system and a work machine.

BACKGROUND ART

For example, it is required to control operation of a work machine such as a hydraulic excavator such that the work machine and an obstacle such as a worker or another work machine do not interfere with each other when the obstacle has intruded into a work range.

As a technology related to such control of a work machine in relation to obstacles, for example, Patent Document 1 discloses a stop control method to be performed regarding an intrusion prohibited area for a work vehicle (work machine) in which an intrusion prohibited area is preset around the work vehicle (work machine), the position of an intruding object such as an worker having intruded into a work area is sensed, and when the intruding object has entered the set intrusion prohibited area, the work vehicle (work machine) is stopped. In the stop control method to be performed regarding the intrusion prohibited area of the work vehicle (work machine), the intrusion prohibited area can be changed according to the work contents of the intruding object such as the worker.

PRIOR ART DOCUMENT

Patent Document

Patent Document 1: JP-2003-105807-A

SUMMARY OF THE INVENTION

Problem to be Solved by the Invention

However, in the conventional technology described above, a relation between the intrusion prohibited area set according to an operation range of the work machine and a monitoring range of a monitoring apparatus is not necessarily taken into consideration sufficiently, and there is concern over the occurrence of problems like the ones below. That is, in the conventional technology described above, for example, when the intrusion prohibited area where intrusion by an intruding object such as an worker is prohibited is set around the work machine, if the intrusion prohibited area is set such that it includes an area outside the monitoring range of the monitoring apparatus, an intruding object cannot be detected in the intrusion prohibited area set outside the monitoring range of the monitoring apparatus. In addition, in the conventional technology, since it is not supposed a case where a plurality of monitoring apparatuses are used, if coordination among these monitoring apparatuses is not ensured where the monitoring ranges of the monitoring apparatuses are arranged so as to overlap each other, there has been a fear that a structure included in the work machine is erroneously detected as an intruding object by any one of the monitoring apparatuses undesirably.

The present invention has been made in view of the description above, and an object of the present invention is to provide an intrusion monitoring control system and a work machine that make it possible to appropriately set an intrusion prohibited area, and reduce detection failures and detection errors.

Means for Solving the Problem

The present application includes a plurality of means for solving the problems described above, and an example thereof is an intrusion monitoring control system including: a monitoring apparatus that detects an obstacle located around a work machine, and outputs obstacle information; and a controller that is configured to calculate an operation limiting command for limiting operation of the work machine in accordance with an intrusion prohibited area set on the basis of a result of comparison between a movable range of the work machine and a monitoring range of the monitoring apparatus and in accordance with the obstacle information from the monitoring apparatus.

Advantages of the Invention

According to the present invention, it is possible to appropriately set an intrusion prohibited area, and reduce detection failures and detection errors.

MODES FOR CARRYING OUT THE INVENTION

Figure 1:
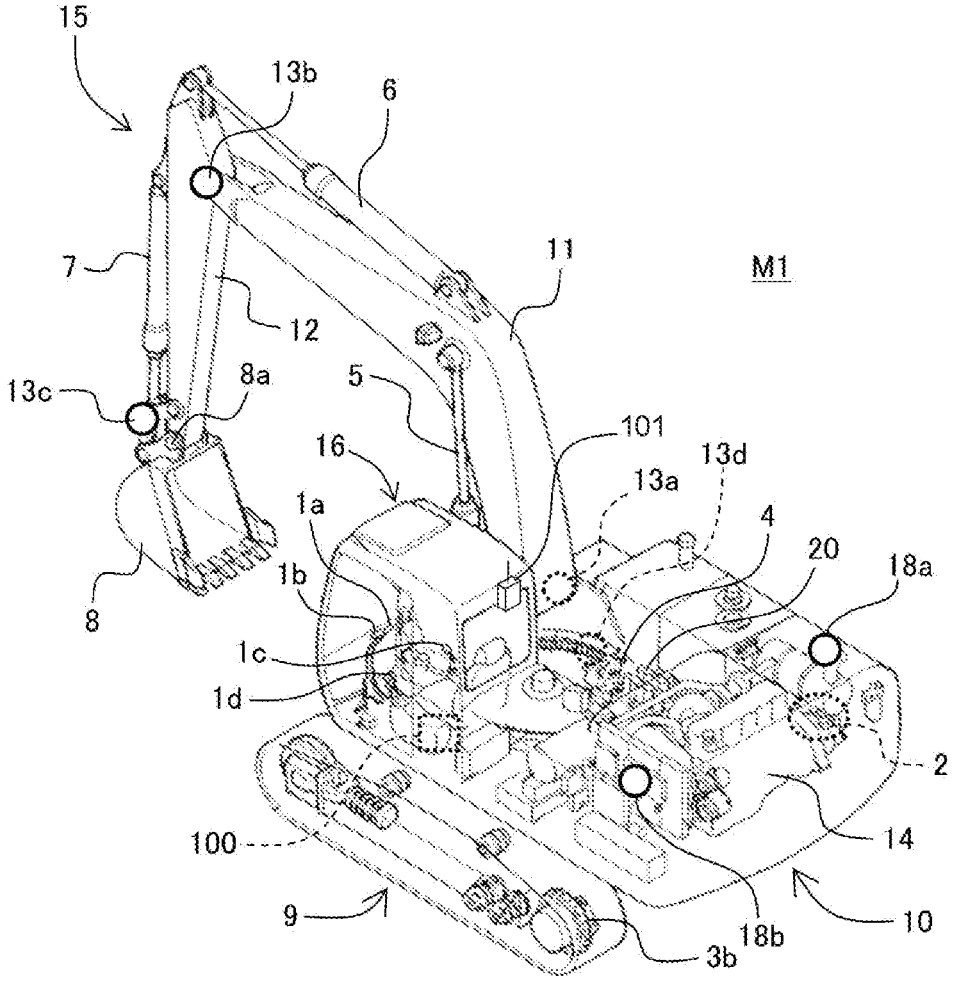
FIG. 1 is an external view schematically depicting the external appearance of a hydraulic excavator which is an example of a work machine.

Embodiments of the present invention are explained below with reference to the figures.

Note that although a hydraulic excavator including a work implement (front work implement) is explained as an example of a work machine in the present embodiments, for example, the present invention can be applied also to a road machine such as a road roller, a crane, and the like in addition to another work machine such as a wheel loader.

In addition, although alphabetical characters are given at the ends of reference characters (numbers) in some cases when there are a plurality of identical constituent elements in the explanation below, the plurality of constituent elements are written collectively by omitting the alphabetical characters in some cases. For example, if there are four inertial measurement units 13*a* to 13*d*, these are collectively denoted as inertial measurement units 13 in some cases.

First Embodiment

A first embodiment of the present invention is explained in detail with reference to FIG. 1 to FIG. 11.

The present embodiment relates to an intrusion monitoring control system that detects obstacles located around a work machine (e.g. a hydraulic excavator M1) by one or more monitoring apparatuses N1, . . . , and Nn (n: positive integer) (see FIG. 2, FIG. 3 or the like), outputs detected results as obstacle information, and generates an operation limiting command for limiting operation of the work machine in accordance with the obstacle information from the monitoring apparatuses N1, . . . , and Nn and an intrusion prohibited area set on the basis of the movable range of the hydraulic excavator M1 and the monitoring ranges of the monitoring apparatuses N1, . . . , and Nn.

FIG. 1 is an external view schematically depicting the external appearance of the hydraulic excavator which is an example of the work machine according to the present embodiment.

In FIG. 1, the hydraulic excavator M1 includes: an articulated-type front work implement 15 including a plurality of driven members (a boom 11, an arm 12, and a bucket (work tool) 8) each of which is pivoted vertically, and is coupled with each other; and an upper swing structure 10 and a lower travel structure 9 included in the machine body. The upper swing structure 10 is swingably provided relative to the lower travel structure 9.

The base end of the boom 11 of the front work implement 15 is vertically pivotably supported at a front portion of the upper swing structure 10, one end of the arm 12 is vertically pivotably supported at the tip of the boom 11, and a bucket 8 is vertically pivotably supported at another end of the arm 12 via a bucket link 8*a*.

The boom 11, the arm 12, the bucket 8, the upper swing structure 10, and the lower travel structure 9 are driven by a boom cylinder 5, an arm cylinder 6, a bucket cylinder 7, a swing hydraulic motor 4, and left and right travel hydraulic motors 3 (only the left side 3*b* is depicted), respectively, which are hydraulic actuators. The travel hydraulic motors 3 function as a moving apparatus by driving a pair of left and right crawlers.

In an operation room 16 which an operator gets on, a right operation lever device 1*c* and a left operation lever device 1*d* that output operation signals for operating the hydraulic actuators 5 to 7 of the front work implement 15 and the swing hydraulic motor 4 of the upper swing structure 10, a travel right operation lever device 1*a* and a travel left operation lever device 1*b* that output operation signals for operating the left and right travel hydraulic motors 3 of the lower travel structure 9, and a controller (controller) 100 are provided.

The operation lever devices 1*a*, 1*b*, 1*c*, and 1*d* are electric operation lever devices that output electric signals as operation signals, and have operation levers that are operated to be inclined forward/backward and leftward/rightward by the operator, and electric signal generating sections that generate electric signals according to the inclination directions and inclination amounts (lever operation amounts) of the operation levers. Electric signals output from the operation lever devices 1*c* and 1*d* are input to the controller 100 via electric wires. In the present embodiment, forward/backward operation and leftward/rightward operation of the operation lever of the right operation lever device 1*c* corresponds to operation of the boom cylinder 5 and operation of the bucket cylinder 7, respectively. On the other hand, forward/backward operation and leftward/rightward operation of the operation lever of the left operation lever device 1*d* correspond to operation of the swing hydraulic motor 4 and operation of the arm cylinder 6, respectively.

Operation control of the boom cylinder 5, the arm cylinder 6, the bucket cylinder 7, the swing hydraulic motor 4, and the left and right travel hydraulic motors 3 is performed by controlling, by using a control valve 20, the direction and flow rate of a hydraulic working fluid supplied from a hydraulic pump apparatus 2 driven by a prime mover (an engine 14 in the present embodiment) such as an engine or an electric motor to the hydraulic actuators 3 and 4 to 7.

Operation of the control valve 20 is controlled by operation control signals output from the controller 100. For example, the control valve 20 has a plurality of solenoid proportional valves as a functionality to generate pilot pressures on the basis of the operation control signals, the control valve 20 is driven by the pilot pressures generated on the basis of the operation control signals, and the direction and flow rate of the hydraulic working fluid supplied from the hydraulic pump apparatus 2 to the hydraulic actuators 3 and 4 to 7 are controlled.

By the operation control signals being output from the controller 100 to the control valve 20 on the basis of operation of the travel right operation lever device 1*a* and the travel left operation lever device 1*b*, operation of the left and right travel hydraulic motors 3 of the lower travel structure 9 is controlled. In addition, by the operation control signals being output from the controller 100 to the control valve 20 on the basis of the operation signals from the operation lever devices 1*c* and 1*d*, operation of the hydraulic actuators 4 to 7 is controlled. The extension and contraction of the boom cylinder 5 pivots the boom 11 vertically relative to the upper swing structure 10, the extension and contraction of the arm cylinder 6 pivots the arm 12 upward/downward and forward/backward relative to the boom 11, and the extension and contraction of the bucket cylinder 7 pivots the bucket 8 upward/downward and forward/backward relative to the arm 12.

Inertial measurement units (IMUs: Inertial Measurement Units) 13*a* to 13*d* as posture information acquiring devices for acquiring posture information are arranged near a coupling portion of the boom 11 with the upper swing structure 10, near a coupling portion of the arm 12 with the boom 11, at the bucket link 8*a*, and at the upper swing structure 10, respectively. The inertial measurement unit 13*a* is a posture information acquiring device (boom posture sensor) that senses the angle (boom angle) of the boom 11 relative to the horizontal plane, the inertial measurement unit 13*b* is a posture information acquiring device (arm posture sensor) that senses the angle (arm angle) of the arm 12 relative to the horizontal plane, and the inertial measurement unit 13*c* is a posture information acquiring device (bucket posture sensor) that senses the angle of the bucket link 8*a* relative to the horizontal plane. In addition, the inertial measurement unit 13*d* is a posture information acquiring device (machine body posture sensor) that senses the inclination angles (the roll angle and pitch angle) of the upper swing structure 10 relative to the horizontal plane.

The inertial measurement units 13*a* to 13*d* measure angular velocities and accelerations. Supposing that the upper swing structure 10 and the driven members (the bucket (work tool) 8, the boom 11, and the arm 12) having the inertial measurement units 13*a* to 13*d* arranged thereon are stationary, the angles of the upper swing structure 10 and the driven members (the bucket (work tool) 8, the boom 11, and the arm 12) relative to the horizontal plane can be sensed on the basis of the directions (i.e. the vertically downward direction) of gravitational accelerations in IMU coordinate systems set for the inertial measurement units 13*a* to 13*d*, and the attachment states of the inertial measurement units 13*a* to 13*d* (i.e. each relative positional relation between one of the inertial measurement units 13*a* to 13*d* and a corresponding one of the upper swing structure 10 and the driven members (the bucket (work tool) 8, the boom 11, and the arm 12). Here, the inertial measurement units 13*a* to 13*c* are included in a posture information acquiring device that acquires posture information (an angle signal) of each of the boom 11, the arm 12, and the bucket (work tool) 8.

Note that the posture information acquiring device may use not only the inertial measurement units (IMUs), but may instead be configured to acquire posture information by using inclination angle sensors, for example. In addition, potentiometers may be arranged at the coupling portions of the driven members (the bucket (work tool) 8, the boom 11, and the arm 12), relative directions (posture information) of the upper swing structure 10 and the driven members (the bucket (work tool) 8, the boom 11, and the arm 12) may be sensed, and the postures (angles relative to the horizontal plane) of the driven members (the bucket (work tool) 8, the boom 11, and the arm 12) may be determined from the sensing results. In addition, stroke sensors may be arranged at the boom cylinder 5, the arm cylinder 6, and the bucket cylinder 7, relative directions (posture information) at connecting portions of the upper swing structure 10 and the driven members (the bucket (work tool) 8, the boom 11 and the arm 12) may be calculated from stroke change amounts, and the postures (angles relative to the horizontal plane) of the driven members (the bucket (work tool) 8, the boom 11, and the arm 12) may be determined from the results of the calculation, in another possible configuration.

On the upper swing structure 10, positioning apparatuses 18*a* and 18*b* as position information acquiring apparatuses that acquire machine position information which is information about the position of the machine body are provided. The positioning apparatuses 18*a* and 18*b* are global navigation satellite systems (GNSSs), for example. A GNSS is a satellite positioning system that receives signals from a plurality of satellites, and finds its position on the Earth. The positioning apparatus 18*a* and 18*b* receive signals (electric waves) from a plurality of GNSS satellites (not depicted) positioned in the space above the Earth, and by performing computations on the basis of the obtained signals, acquire the positions of the positioning apparatuses 18*a* and 18*b* in the terrestrial coordinate system. Relative mounting positions of the positioning apparatuses 18*a* and 18*b* relative to the hydraulic excavator M1 are known in advance from design information or the like, and thus by acquiring the positions of the positioning apparatuses 18*a* and 18*b* in the terrestrial coordinate system, the position and direction (azimuth) of the hydraulic excavator M1 relative to reference points of a construction site can be acquired as machine position information. Note that it is supposed in the present embodiment that the machine position information is represented in a local coordinate system set for the construction site.

The controller 100 receives, as input, the operation signals from the operation lever devices 1*a* to 1*d*, the posture information from the inertial measurement units 13*a* to 13*d*, the machine position information from the positioning apparatuses 18*a* and 18*b*, and monitoring range information (mentioned later) and obstacle information (mentioned later) from the monitoring apparatuses N1, . . . , and Nn received via a communication apparatus 101, and the controller 100 outputs the operation control signals on the basis of the input, and drives the control valve 20. Note that the number of the monitoring apparatuses N1, . . . , and Nn may be one or greater than one, and when there are a plurality of the monitoring apparatuses N1, . . . , and Nn, obstacle information and monitoring range information are input separately from each of the monitoring apparatuses N1, . . . , and Nn.

Figure 2:
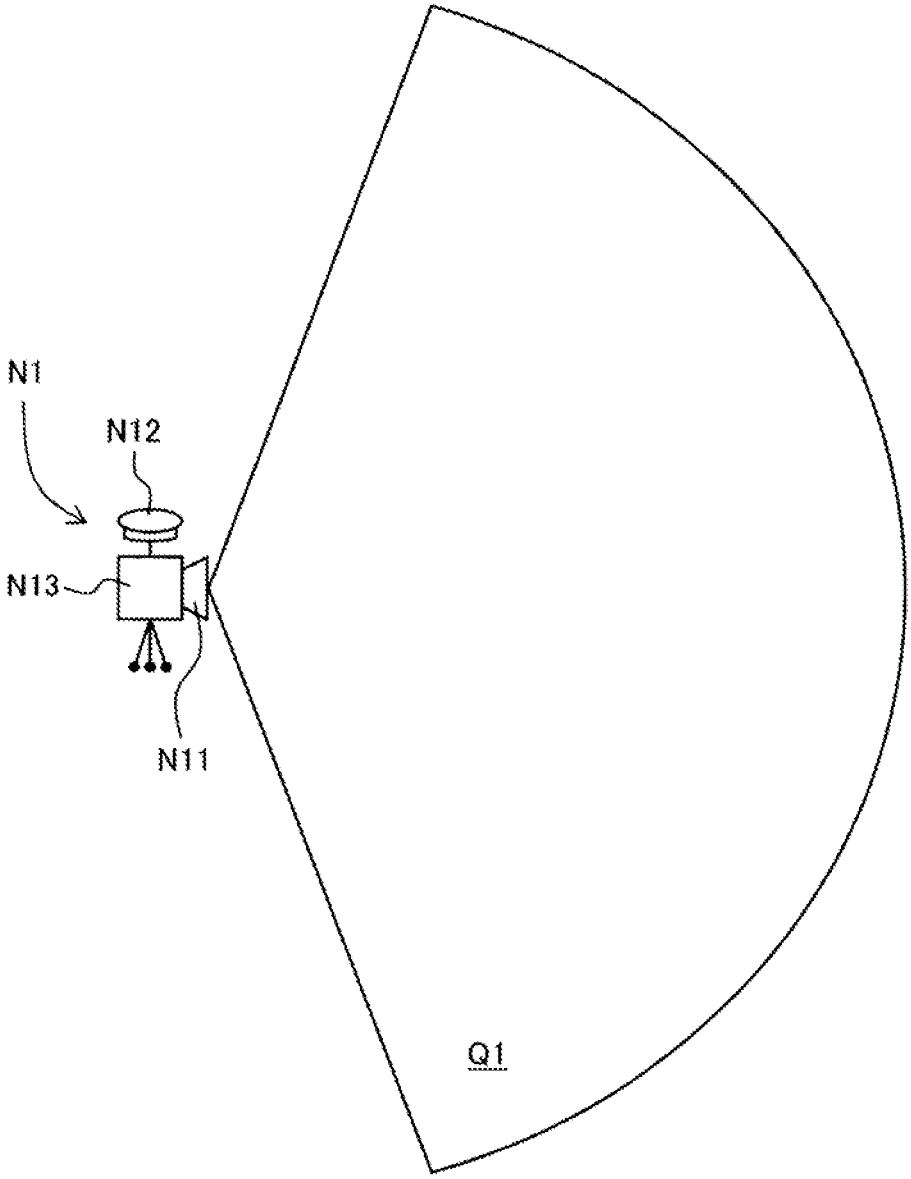
FIG. 2 is a figure schematically depicting a monitoring apparatus.

FIG. 2 is a figure schematically depicting a monitoring apparatus according to the present embodiment.

In FIG. 2, the monitoring apparatus N1 includes a sensing section N11, a positioning apparatus N12, and a communication section N13.

The sensing section N11 can sense the position of an object such as an obstacle having intruded into the inside of a preset monitoring range Q1. The monitoring range Q1 is set as specifications in advance, and is stored on a storage section of the monitoring apparatus N1 which is not depicted. The sensing section N11 senses, as obstacle information, the position of an object in a coordinate system set for the monitoring apparatus N1.

For example, the positioning apparatus N12 includes a global navigation satellite system (GNSS) and an azimuth measuring apparatus (e.g. an electromagnetic compass using a geomagnetic sensor or the like), and can sense the position and direction (azimuth) of the monitoring apparatus N1.

The communication section N13 transmits the monitoring range information and the obstacle information from the monitoring apparatus N1 to the communication apparatus 101 of the hydraulic excavator M1.

The monitoring apparatus N1 has a functionality of converting the monitoring range Q1 and obstacle information into a monitoring range Q1 and obstacle information in the local coordinate system set for the construction site on the basis of the position and azimuth of the positioning apparatus N12, and transmits, from the communication section N13 to the hydraulic excavator M1, the converted monitoring range Q1 in the local coordinate system as monitoring range information, along with the converted obstacle information in the local coordinate system. That is, in the present embodiment, the obstacle information and the monitoring range information are both represented in the local coordinate system set for the construction site.

Note that although the monitoring apparatus N1 includes the positioning apparatus N12 in the configuration depicted as an example explained in the present embodiment, this is not the sole example, and, for example, the position and azimuth of the monitoring apparatus N1 in the local coordinate system may be measured in advance, and input to (stored on) the monitoring apparatus N1 in advance, in another possible configuration.

Figure 3:
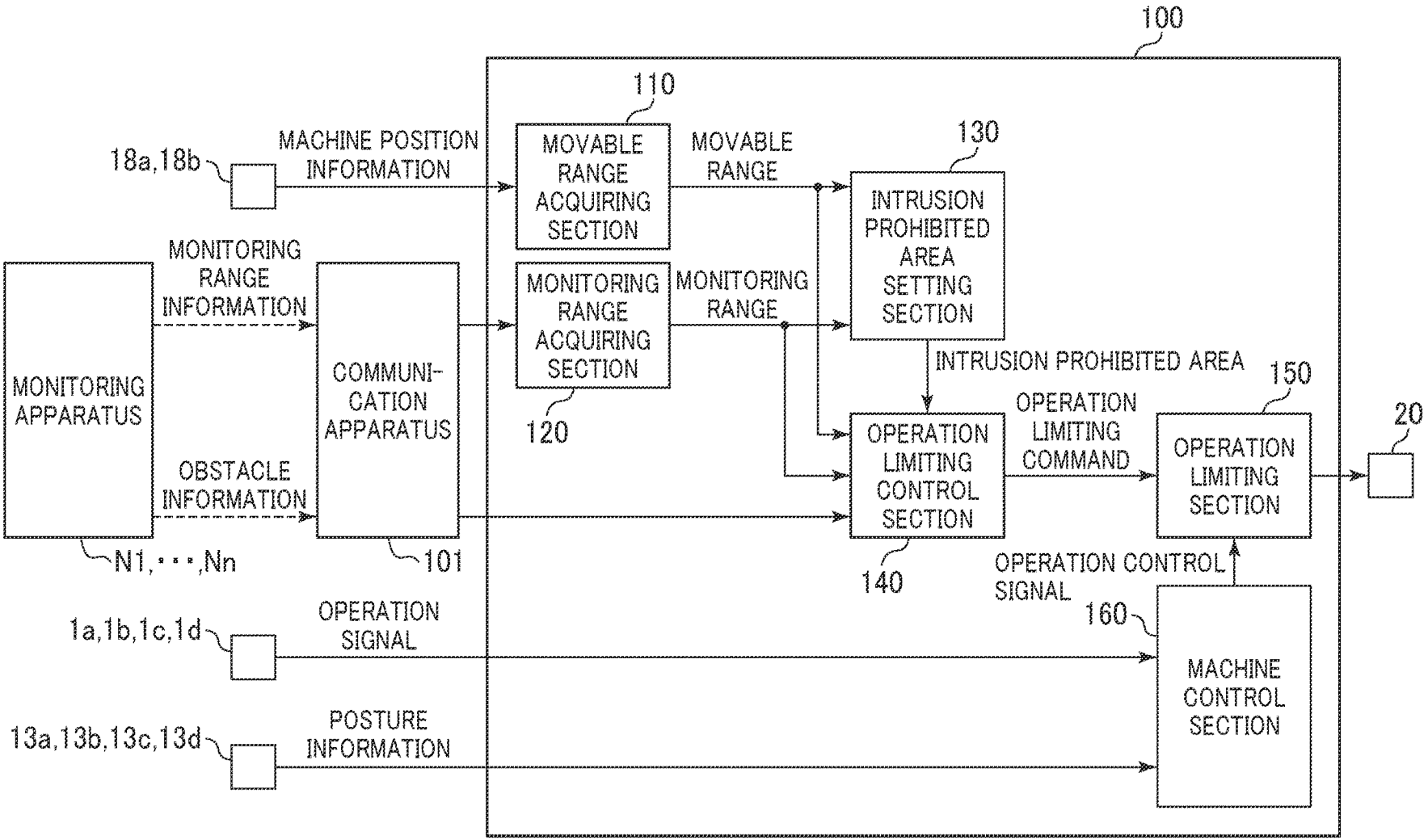
FIG. 3 is a functional block diagram depicting processing functionalities of a controller according to the first embodiment.

FIG. 3 is a functional block diagram depicting processing functionalities of the controller.

In FIG. 3, the controller 100 includes a movable range acquiring section 110, a monitoring range acquiring section 120, an intrusion prohibited area setting section 130, an operation limiting control section 140, an operation limiting section 150, and a machine control section 160.

The movable range acquiring section 110 computes a movable range of the hydraulic excavator M1 on the basis of the machine position information from the positioning apparatuses 18*a* and 18*b*, and outputs the movable range to the intrusion prohibited area setting section 130 and the operation limiting control section 140. For example, the movable range may be the maximum swing radius of the hydraulic excavator M1. Alternatively, the posture information also may be input to the movable range acquiring section 110, and an operation range where the hydraulic excavator M1 at its current position and posture can reach within a predetermined length of time may be computed as the movable range. The maximum swing radius of the hydraulic excavator M1 is used as the movable range in the case explained as an example in the following explanation.

The monitoring range acquiring section 120 computes, on the basis of the monitoring range information from the monitoring apparatuses N1, . . . , and Nn, a monitoring range as a range where any one of the monitoring apparatuses N1, . . . , and Nn can perform monitoring, and outputs the monitoring range to the intrusion prohibited area setting section 130 and the operation limiting control section 140.

The intrusion prohibited area setting section 130 computes an intrusion prohibited area on the basis of the movable range from the movable range acquiring section 110 and the monitoring range from the monitoring range acquiring section 120, and outputs the intrusion prohibited area to the operation limiting control section 140. Note that the computation of the intrusion prohibited area at the intrusion prohibited area setting section 130 is mentioned later.

The operation limiting control section 140 computes an operation limiting command on the basis of the movable range from the movable range acquiring section 110, the monitoring range from the monitoring range acquiring section 120, the intrusion prohibited area from the intrusion prohibited area setting section 130, and the obstacle information from the monitoring apparatuses N1, . . . , and Nn, and outputs the operation limiting command to the operation limiting section 150. Note that the computation of the operation limiting command at the operation limiting control section 140 is mentioned later.

The machine control section 160 computes an operation control signal on the basis of the operation signals from the operation lever devices 1*a* to 1*d* and the posture information from the inertial measurement units 13*a* to 13*d*, and outputs the operation control signal to the control valve 20 via the operation limiting section 150.

The operation limiting section 150 limits the transfer, to the control valve 20, of the operation control signal output from the machine control section 160, on the basis of the operation limiting command from the operation limiting control section 140. That is, the operation limiting section 150 stops driving of the control valve 20 by interrupting the operation control signal output from the machine control section 160 to the control valve 20 and stops (limits) operation of the hydraulic actuators 4 to 7 when an operation stop command (mentioned later) is being output as the operation limiting command from the operation limiting control section 140. In addition, the operation limiting section 150 limits driving of the control valve 20 by limiting the operation control signal output from the machine control section 160 to the control valve 20 (e.g. reducing the signal at a rate) and limits the velocities of the hydraulic actuators 4 to 7 when a velocity limiting command (mentioned later) is being output as the operation limiting command from the operation limiting control section 140. In addition, the operation limiting section 150 permits the transfer, to the control valve 20, of the operation control signal output from the machine control section 160 when the operation limiting command is not being output from the operation limiting control section 140.

Figure 4:
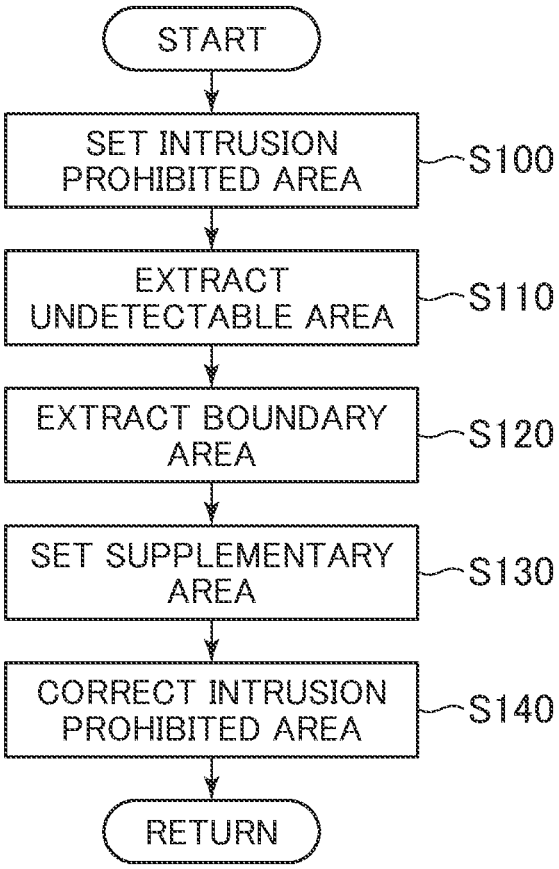
FIG. 4 is a flowchart depicting the contents of processes at an intrusion prohibited area setting section.

FIG. 4 is a flowchart depicting the contents of processes at the intrusion prohibited area setting section. In addition, FIG. 5 to FIG. 9 are figures for explaining details of the contents of the processes at the intrusion prohibited area setting section. An explanation is given here by depicting, as an example, a case where the two monitoring apparatuses N1 and N2 are used as monitoring apparatuses.

Figure 5:
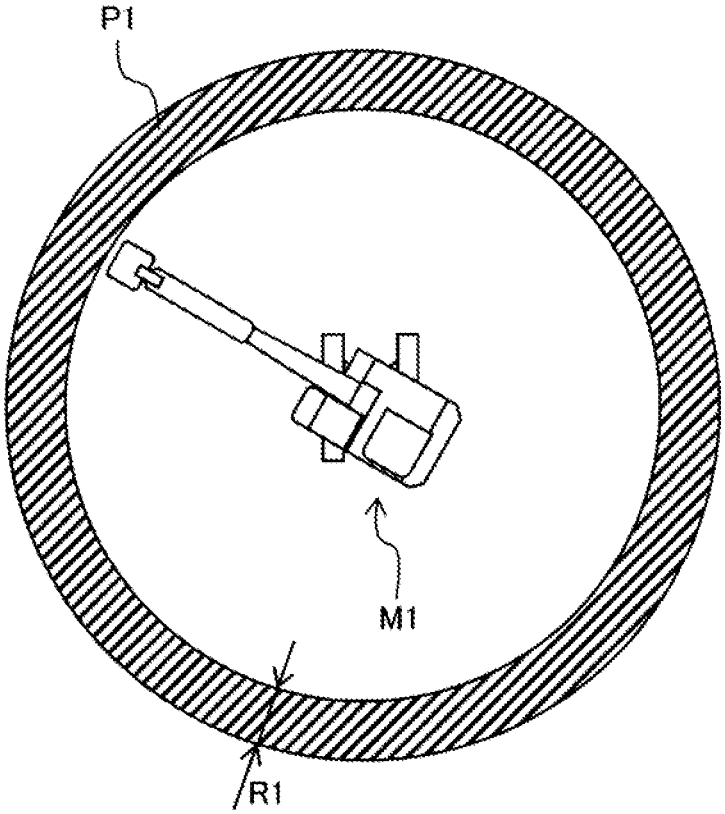
FIG. 5 is a figure for explaining details of the contents of the processes at the intrusion prohibited area setting section.

In FIG. 4, the intrusion prohibited area setting section 130 first sets an intrusion prohibited area P1 on the basis of a movable range of the hydraulic excavator M1 (Step S100). For example, as depicted in FIG. 5, an area represented by a ring having a radius which is larger than the maximum swing radius of the hydraulic excavator M1 by a width R1 is set as the intrusion prohibited area P1. Here, the width R1 may be set on the basis of a length of time required for the hydraulic excavator M1 in a swinging motion to stop and movement velocities of objects that are supposed to be present as intruding objects at a construction site. In addition, as the swing velocity of the hydraulic excavator M1, the maximum swing velocity may be used or the actual swing velocity may be used.

Figure 6:
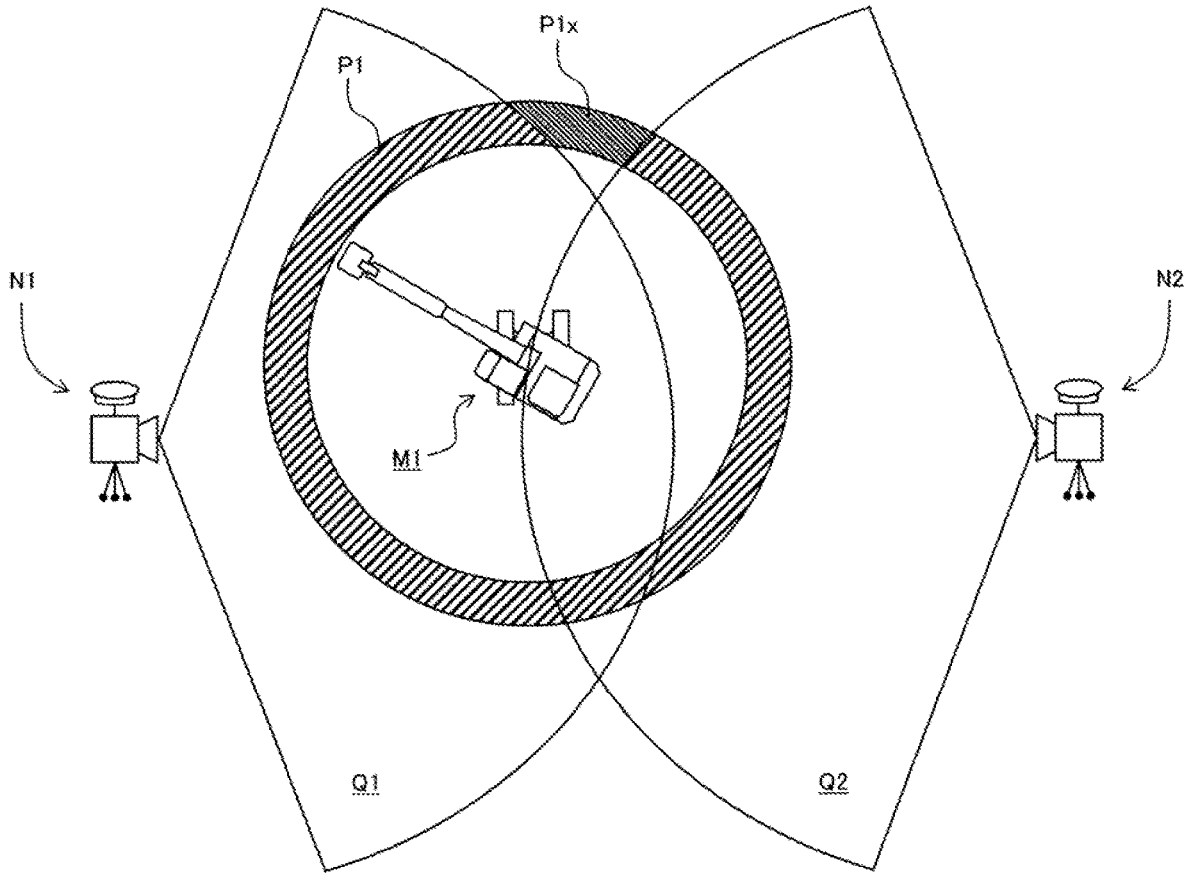
FIG. 6 is a figure for explaining details of the contents of the processes at the intrusion prohibited area setting section.

Next, as depicted in FIG. 6, the intrusion prohibited area P1 and monitoring ranges Q1 and Q2 of the monitoring apparatuses N1 and N2 are compared with each other, and a range which is a part of the intrusion prohibited area P1 and is not included in the monitoring ranges Q1 and Q2 is extracted as an undetectable area Pix (Step S110).

Figure 7:
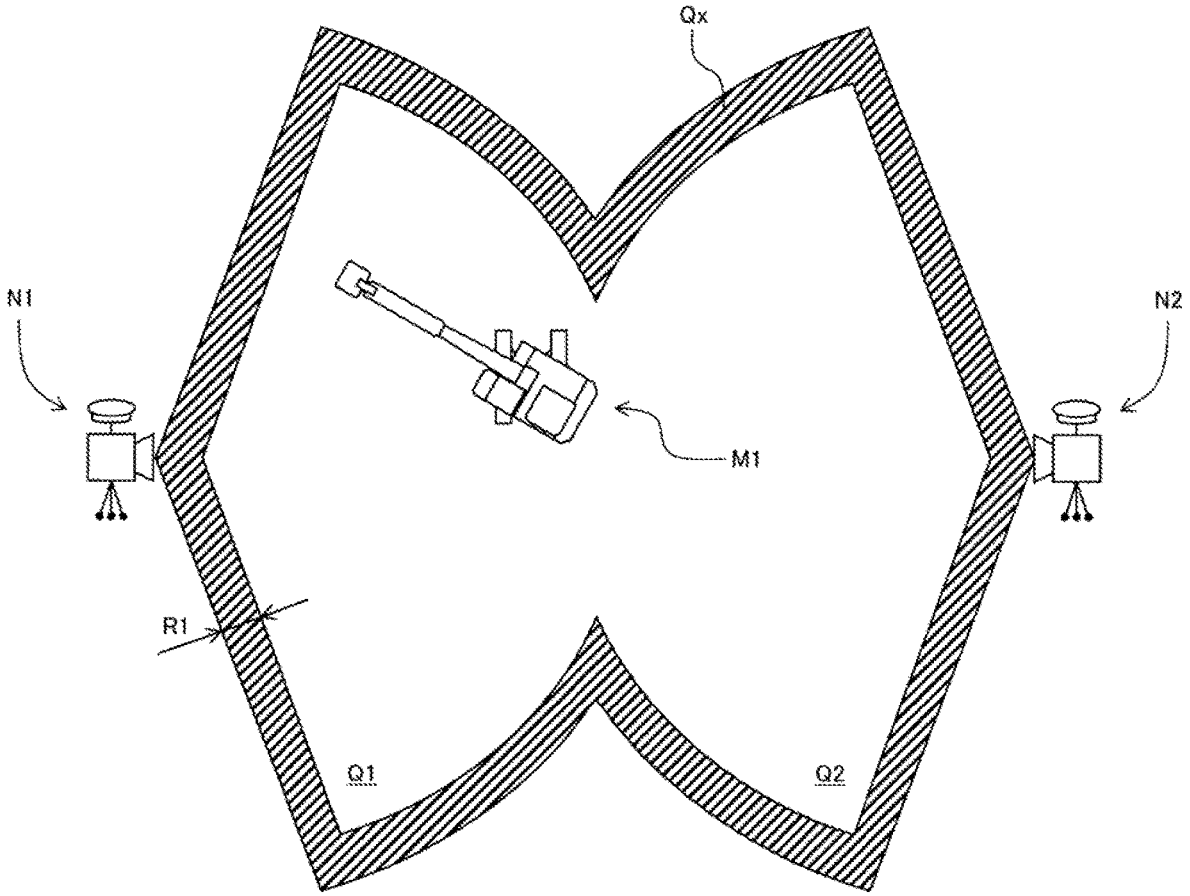
FIG. 7 is a figure for explaining details of the contents of the processes at the intrusion prohibited area setting section.

Next, as depicted in FIG. 7, on the basis of the monitoring ranges Q1 and Q2 of the monitoring apparatuses N1 and N2, a range that occupies a certain width from the perimeters of the monitoring ranges Q1 and Q2 is extracted as a boundary area Qx (Step S120). Note that desirably the width of the boundary area Qx is set to R1.

Figure 8:
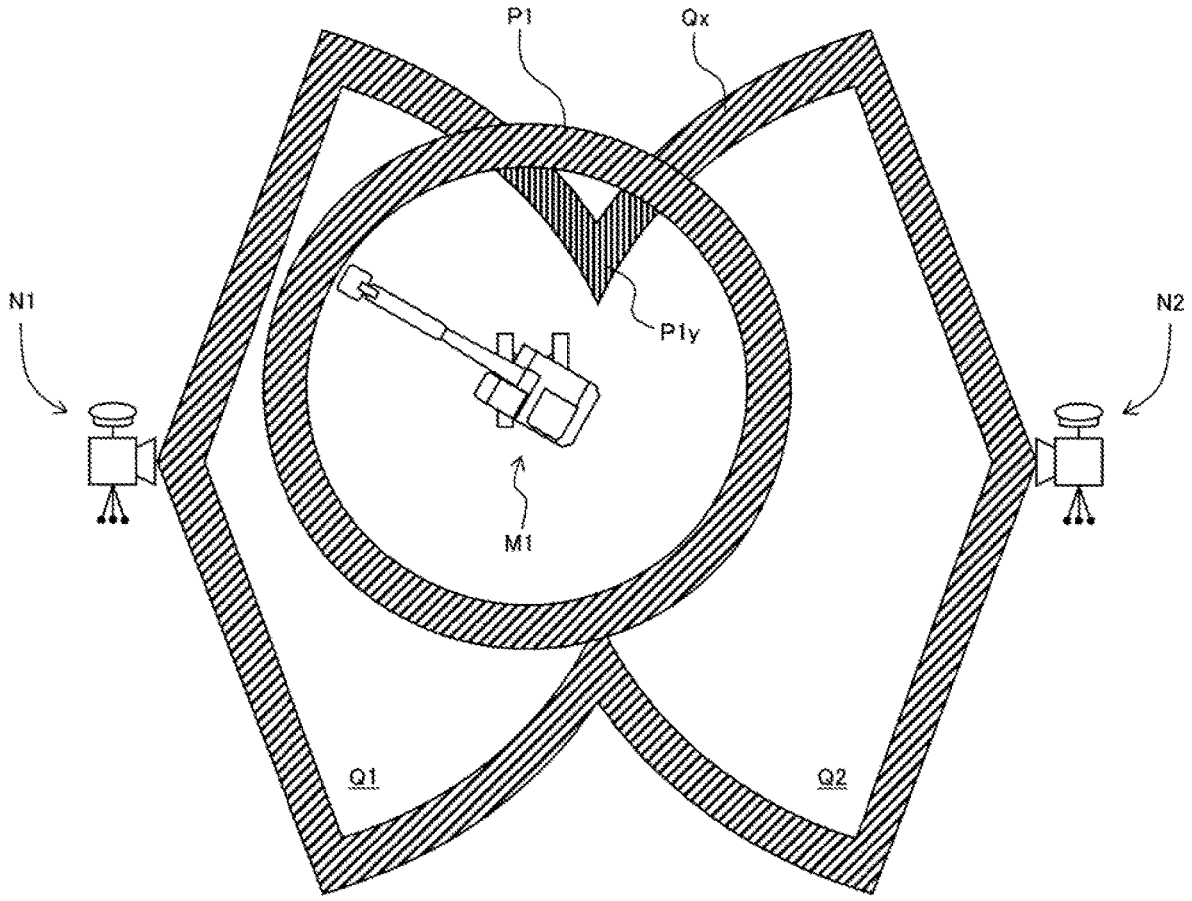
FIG. 8 is a figure for explaining details of the contents of the processes at the intrusion prohibited area setting section.

Next, as depicted in FIG. 8, the intrusion prohibited area P1 and the boundary area Qx are compared with each other, and an area which is a part of the boundary area Qx and is located inside the intrusion prohibited area P1 is set as a supplementary area P1*y* (Step S130).

Figure 9:
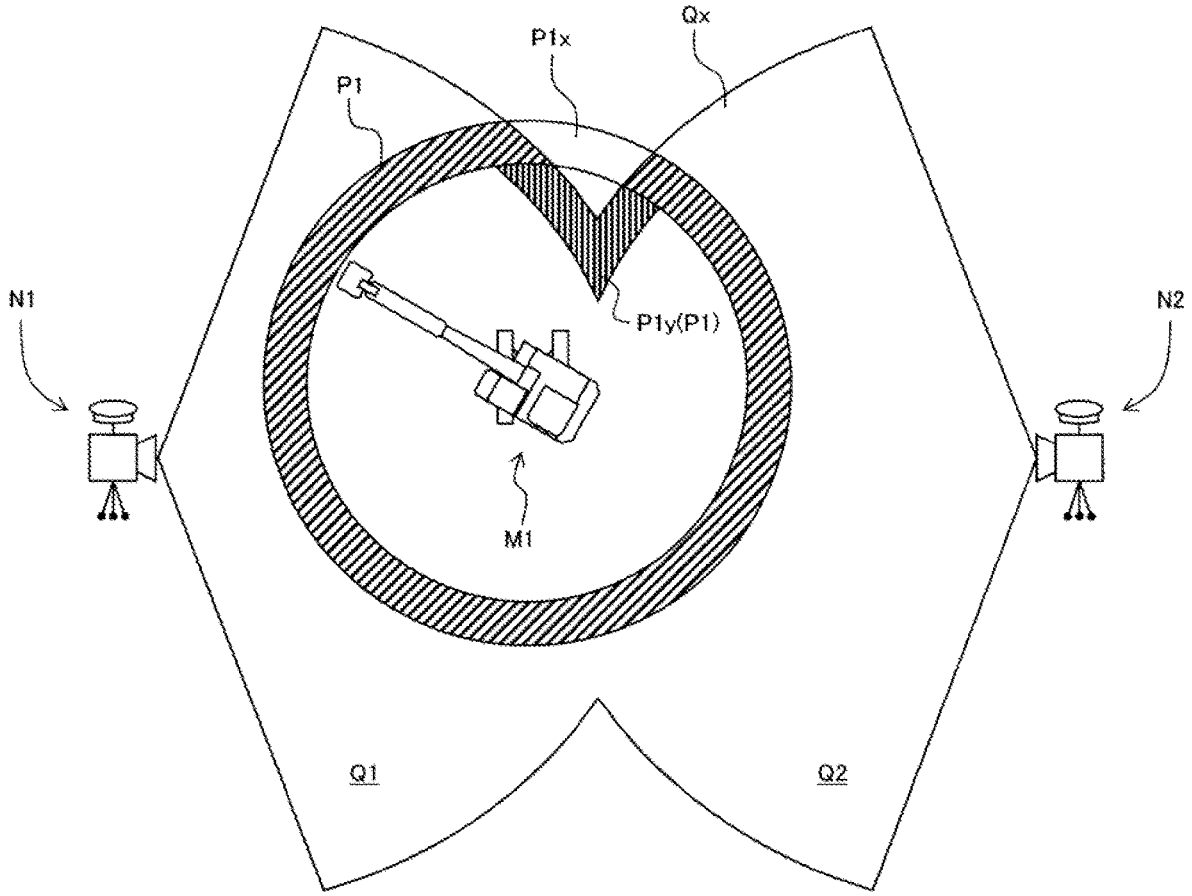
FIG. 9 is a figure for explaining details of the contents of the processes at the intrusion prohibited area setting section.

Next, as depicted in FIG. 9, the undetectable area Pix is excluded from the intrusion prohibited area P1, and furthermore the supplementary area P1*y* is added to the intrusion prohibited area P1. The intrusion prohibited area P1 obtained thereby is set as a new intrusion prohibited area P1.

Figure 10:
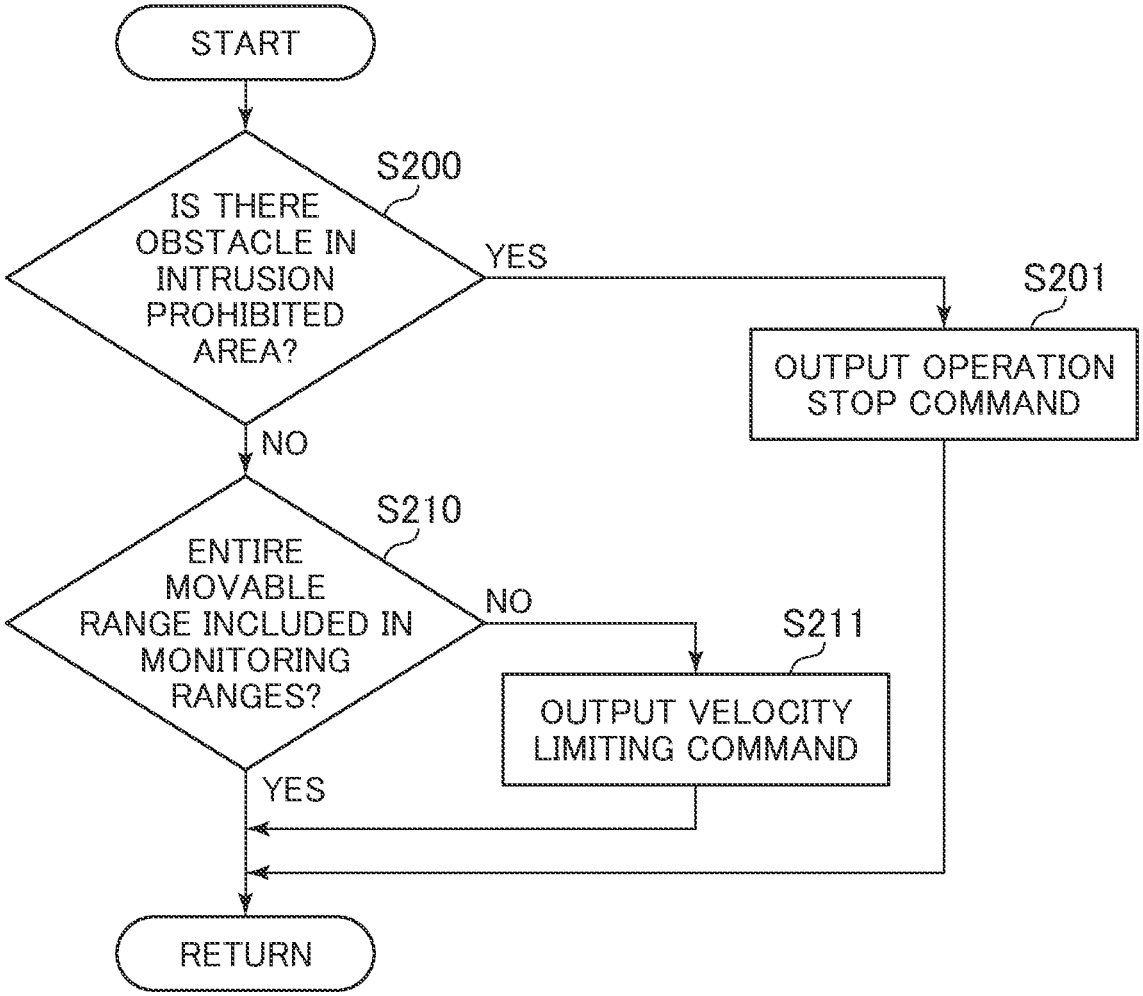
FIG. 10 is a flowchart depicting the contents of processes at an operation limiting control section.
Figure 11:
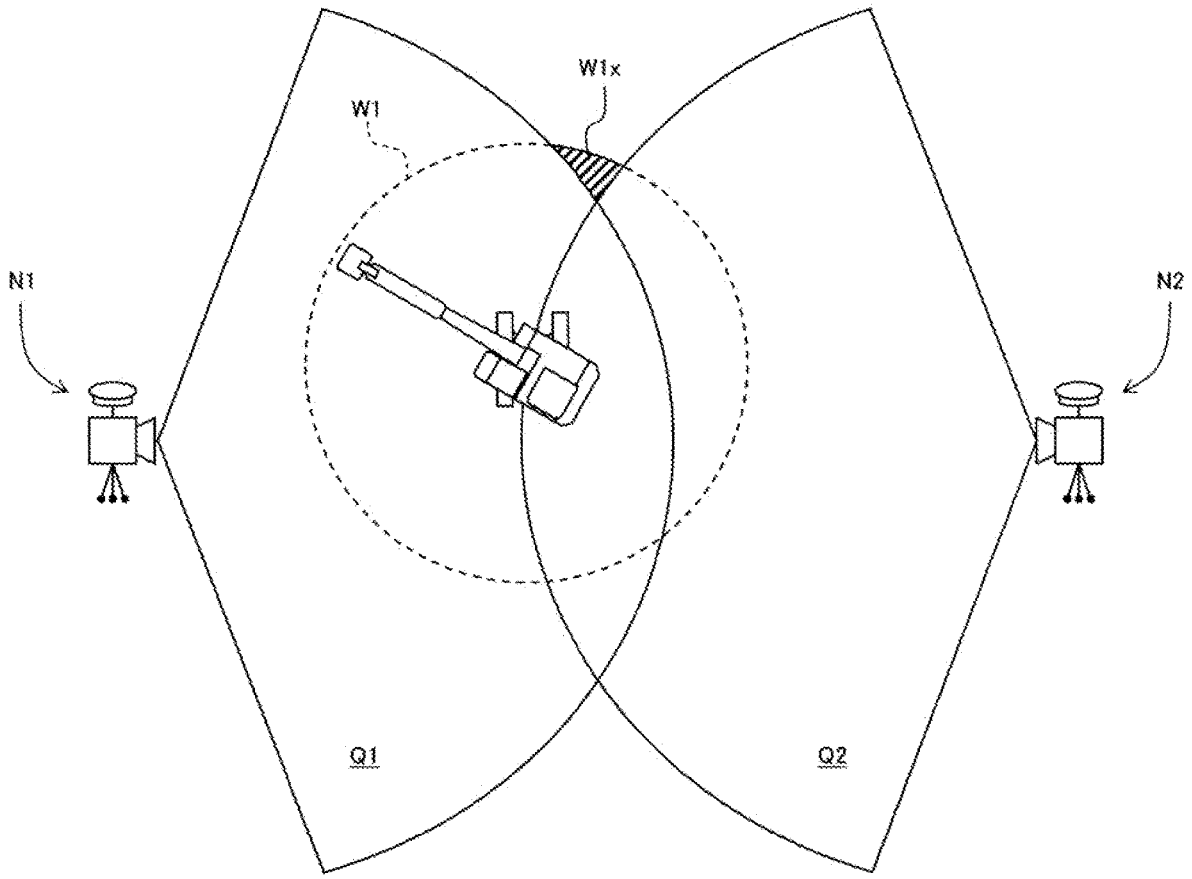
FIG. 11 is a figure for explaining an example of comparison between a movable range and monitoring ranges.

FIG. 10 is a flowchart depicting the contents of processes at the operation limiting control section. In addition, FIG. 11 is a figure for explaining an example of comparison between a movable range and monitoring ranges.

In FIG. 10, the operation limiting control section 140 first decides whether or not there is an obstacle in the intrusion prohibited area P1 (Step S200). When the result of the decision is YES, the operation limiting control section 140 outputs the operation stop command as the operation limiting command to the operation limiting section 150, stops operation of the hydraulic excavator M1 (Step S201), and ends the process.

Note that in addition to deciding an intruding object as an obstacle in a case where the intruding object has entered the intrusion prohibited area P1, a part of the hydraulic excavator M1 is decided as an obstacle also in a case where the part of the hydraulic excavator M1 has entered the intrusion prohibited area, and operation of the hydraulic excavator M1 is stopped. By performing control in this manner, in addition to being able to stop the hydraulic excavator M1 in a case where an intruding object has entered the intrusion prohibited area P1, it is also possible to prevent the hydraulic excavator M1 from going out of the intrusion prohibited area P1.

Next, the movable range of the hydraulic excavator M1 and the monitoring ranges Q1 and Q2 of the monitoring apparatuses N1 and N2 are compared with each other, and it is decided whether or not the entire movable range is included in the monitoring ranges Q1 and Q2 (Step S210). When the result of the decision at Step S210 is NO, that is, when at least a part of the movable range is not included in the monitoring ranges Q1 and Q2, the operation limiting control section 140 outputs, to the operation limiting section 150, the velocity limiting command as the operation limiting command, limits the operation velocity of the hydraulic excavator M1 (Step S211), and ends the process. An example of the case where at least a part of the movable range is not included in the monitoring ranges Q1 and Q2 is, for example, a case where an area W1*x* which is a part of a movable area W1 is not included in the monitoring ranges Q1 and Q2, as depicted in FIG. 11. In addition, when the result of the decision at Step S210 is YES, the process is ended.

By limiting the velocity of the hydraulic excavator M1 in a case where even a part of the movable range is not included in the monitoring ranges Q1 and Q2 in this manner, the velocity of the hydraulic excavator M1 can be limited in advance also in a case where there is a possibility that the hydraulic excavator M1 goes out of the intrusion prohibited area P1, and it is possible to more surely prevent the hydraulic excavator M1 from going out of the intrusion prohibited area P1. Note that in order to more surely prevent the hydraulic excavator M1 from going out of the intrusion prohibited area P1, the extent of reduction of the velocity of the hydraulic excavator M1 may be increased as the area size of the area W1*x* increases, in another possible configuration.

Figure 13:
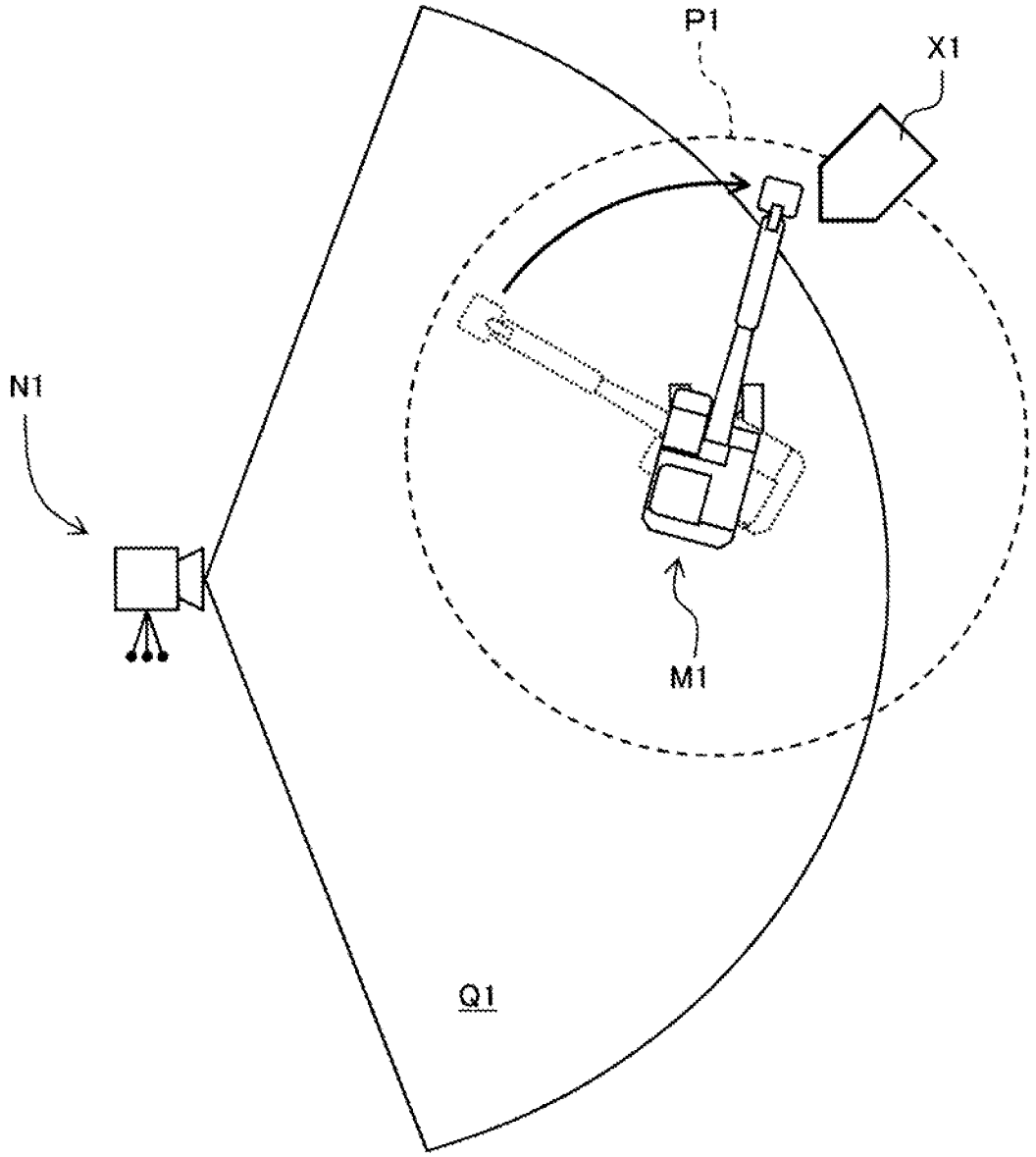
FIG. 13 is a figure depicting an example of a situation of a construction site as a comparative example.
Figure 14:
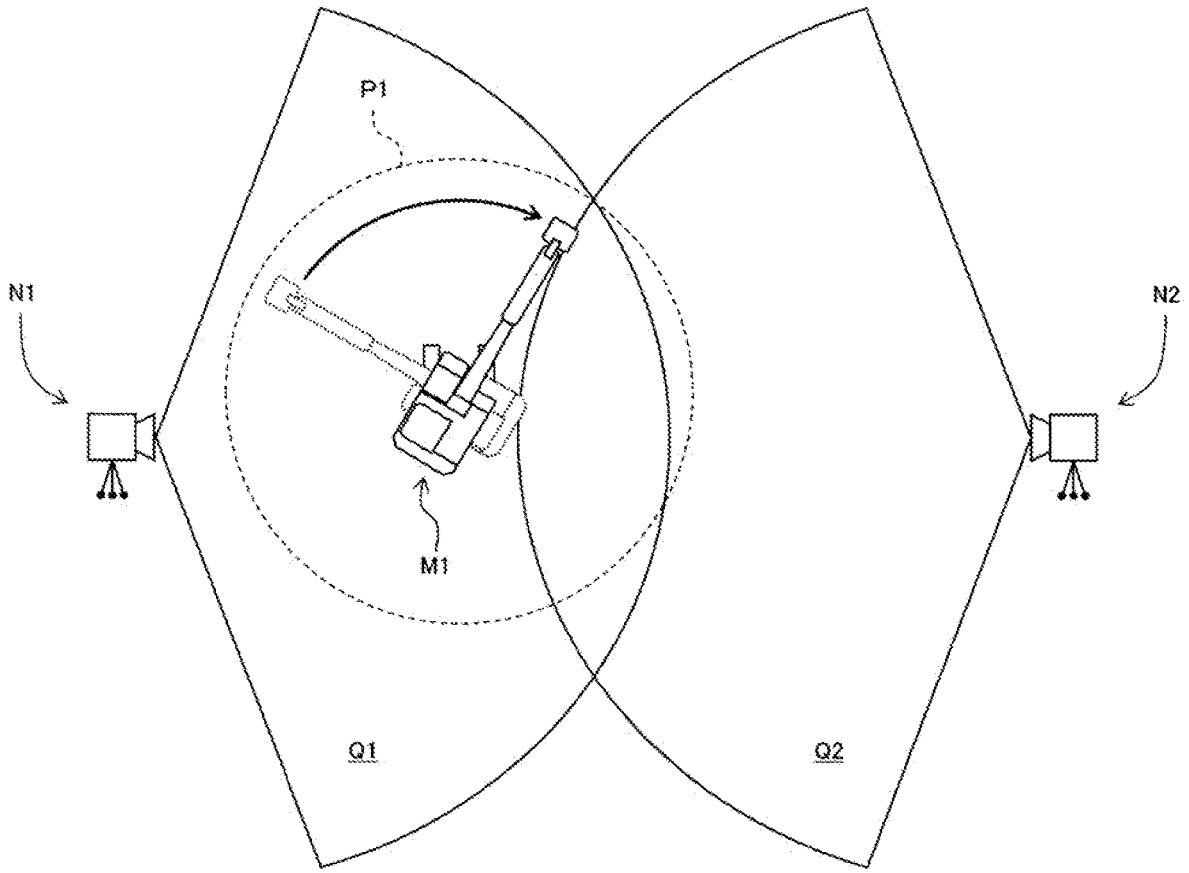
FIG. 14 is a figure depicting an example of a situation of a construction site as a comparative example.

Advantages of the thus configured present embodiment are explained by using FIG. 13 and FIG. 14.

In conventional technologies, a relation between a monitoring range of a monitoring apparatus and an intrusion prohibited area set according to an operation range of a work machine is not necessarily taken into consideration sufficiently. For example, there are possibilities that an intruding object cannot be detected when the intrusion prohibited area is set outside the monitoring range of the monitoring apparatus, that the work machine is erroneously detected as an intruding object undesirably when a plurality of monitoring ranges are set so as to overlap each other, and so on. That is, for example, when the surroundings of a work machine M1 is set as the intrusion prohibited area P1 as depicted in FIG. 13, there is a possibility that the intrusion prohibited area P1 is undesirably set outside the monitoring range Q1 of the monitoring apparatus depending on a positional relation with the monitoring apparatus N1, and an intruding object X1 cannot be detected. In addition, when a monitoring apparatus N2 is installed for increasing the monitoring range as depicted in FIG. 14, there is a possibility that a part of the work machine M1 is erroneously detected as an intruding object undesirably when the part of the work machine M1 has entered a monitoring range Q2 of the monitoring apparatus N2.

In contrast to this, in the present embodiment, since the configuration includes: the monitoring apparatuses N1 and N2 that detect an obstacle located around the hydraulic excavator M1, and output the obstacle information; and the controller 100 that calculates the operation limiting command for limiting operation of the hydraulic excavator M1 in accordance with the obstacle information from the monitoring apparatuses N1 and N2, and the intrusion prohibited area P1 set on the basis of a result of comparison between the movable range of the hydraulic excavator M1 and the monitoring ranges of the monitoring apparatuses N1 and N2, it is possible to appropriately set the intrusion prohibited area, and reduce detection failures and detection errors.

Second Embodiment

A second embodiment of the present invention is explained with reference to FIG. 12.

The present embodiment includes a warning notification control section 240 that outputs a warning notification command, in addition to the operation limiting control section 140 in the first embodiment.

Figure 12:
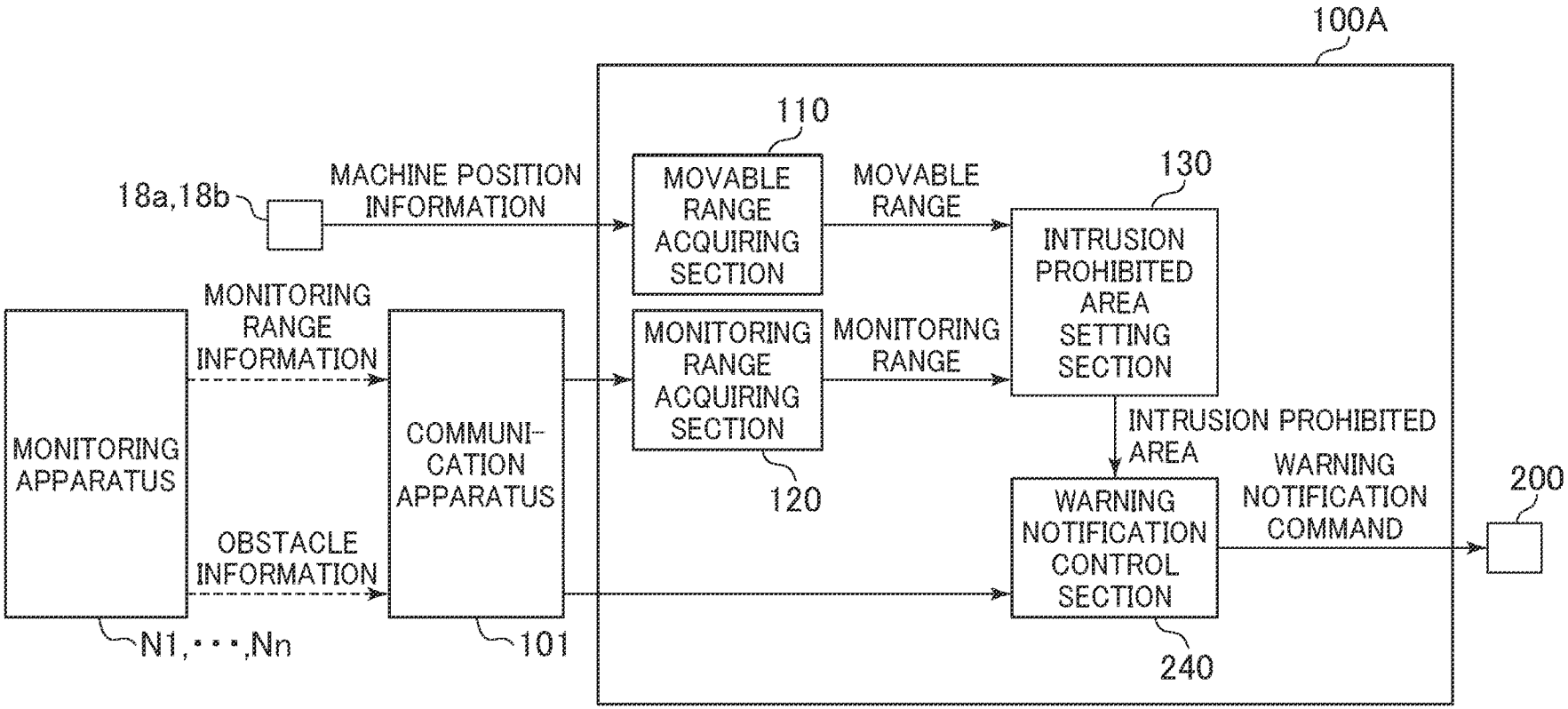
FIG. 12 is a functional block diagram depicting processing functionalities of a controller according to a second embodiment.

FIG. 12 is a functional block diagram depicting processing functionalities of a controller according to the present embodiment. In the figure, members similar to their counterparts in the first embodiment are given the same reference characters, and explanations thereof are omitted. Note that, in FIG. 12, the operation limiting control section 140, the operation limiting section 150, and the machine control section 160 that are explained in the first embodiment are omitted in the figure.

In FIG. 12, a controller 100A includes the movable range acquiring section 110, the monitoring range acquiring section 120, the intrusion prohibited area setting section 130, and the warning notification control section 240.

The warning notification control section 240 computes a warning notification command on the basis of the intrusion prohibited area from the intrusion prohibited area setting section 130, and the obstacle information from the monitoring apparatuses N1, . . . , and Nn, and outputs the warning notification command to a notification device 200. Note that the computation of the warning notification command at the warning notification control section 240 is performed similarly to the computation of the operation limiting command at the operation limiting control section 140 in the first embodiment. That is, the warning notification control section 240 decides, in addition to deciding an intruding object as an obstacle when the intruding object has entered the intrusion prohibited area P1, a part of the hydraulic excavator M1 as an obstacle also when the part of the hydraulic excavator M1 has entered the intrusion prohibited area, and causes the notification device 200 to give a warning by outputting the warning notification command to the notification device 200.

The configuration of the second embodiment is similar to the first embodiment in other respects.

In the thus configured present embodiment also, advantages similar to the first embodiment can be attained.

Next, features of each embodiment described above are explained.

(1) In the embodiments described above, monitoring apparatuses N1, . . . , and Nm that detect an obstacle located around a work machine (e.g. the hydraulic excavator M1), and outputs obstacle information; and a controller (e.g. the controller 100; 100A) that calculates an operation limiting command for limiting operation of the work machine in accordance with an intrusion prohibited area P1 set on the basis of a result of comparison between a movable range of the work machine and monitoring ranges of the monitoring apparatuses and in accordance with the obstacle information from the monitoring apparatuses are included.

Thereby, it is possible to appropriately set an intrusion prohibited area, and reduce detection failures and detection errors.

(2) In addition, in the embodiments described above, in the intrusion monitoring control system according to (1), the work machine (e.g. the hydraulic excavator M1) includes the controller (e.g. the controller 100; 100A), and the controller limits the operation of the work machine on the basis of the obstacle information from the monitoring apparatuses N1, . . . , and Nn.

(3) In addition, in the embodiments described above, in the intrusion monitoring control system according to (1), the monitoring apparatuses N1, . . . , and Nn include the controller (e.g. the controller 100; 100A), and the work machine (e.g. the hydraulic excavator M1) limits the operation thereof on the basis of the operation limiting command from the controller.

(4) In addition, in the embodiments described above, in a work machine (e.g. the hydraulic excavator M1) that operates at a construction site, and includes a controller (e.g. the controller 100; 100A) that controls operation of the work machine, the controller is configured to calculate an operation limiting command for limiting the operation of the work machine in accordance with an intrusion prohibited area P1 set on the basis of a result of comparison between monitoring ranges of monitoring apparatuses N1, . . . , and Nn that detect an obstacle located around the work machine and output obstacle information and a movable range of the work machine and in accordance with the obstacle information from the monitoring apparatuses, and limits the operation of the work machine according to the operation limiting command.

<Notes>

Note that the present invention is not limited to the embodiments described above, and includes various modification examples and combinations within the scope not deviating from the gist of the present invention. In addition, the present invention is not limited to ones including all configurations explained in the embodiments described above, and includes ones from which some of the configurations are deleted. In addition, the configurations, functionalities, and the like described above may partially or entirely be realized by designing them on an integrated circuit, and so on, for example. In addition, the configurations, functionalities, and the like described above may be realized by software by a processor interpreting and executing a program to realize the functionalities.

In addition, although the controllers 100 and 100A are mounted on the hydraulic excavator M1 in the configuration explained in the present embodiment, for example, a control system of the hydraulic excavator (work machine) M1 that includes the controller 100 arranged separately from the hydraulic excavator M1 and enables remote operation of the hydraulic excavator M1 may be configured. In addition, in another possible configuration, functional sections of the controllers 100 and 100A other than the operation limiting section 150 and the machine control section 160 may be separated from the hydraulic excavator M1, and arranged in the monitoring apparatuses N1, . . . , and Nn, for example.

DESCRIPTION OF REFERENCE CHARACTERS

1*a* to 1*d*: Operation lever device
2: Hydraulic pump apparatus
3: Travel hydraulic motor
4: Swing hydraulic motor
5: Boom cylinder
6: Arm cylinder
7: Bucket cylinder
8: Bucket (work tool)
8*a*: Bucket link
9: Lower travel structure
10: Upper swing structure
11: Boom
12: Arm
13: Inertial measurement unit (IMU)
14: Engine
15: Front work implement
16: Operation room
18*a*, 18*b*: Positioning apparatus (GNSS)
20: Control valve
100, 100A: Controller (controller)
101: Communication apparatus
110: Movable range acquiring section
120: Monitoring range acquiring section
130: Intrusion prohibited area setting section
140: Operation limiting control section
150: Operation limiting section
160: Machine control section
200: Notification device
240: Warning notification control section
M1: Hydraulic excavator (work machine)
N1, N2: Monitoring apparatus
N11: Sensing section
N12: Positioning apparatus
N13: Communication section
P1: Intrusion prohibited area
Pix: Undetectable area
P1*y*: Supplementary area
Q1, Q2: Monitoring range
Qx: Boundary area
R1: Width
W1: Movable area
W1*x*: Area
X1: Intruding object

The invention claimed is:

1. An intrusion monitoring control system comprising:

a plurality of monitoring apparatuses including, a sensing section that detects a position of an obstacle that has entered a preset monitoring range located around a work machine, and a communication section that treats the monitoring range as monitoring range information and transmits a position of an obstacle detected in the monitoring range as obstacle information; and a controller on the work machine that controls operation of the work machine and is configured to:

set an intrusion prohibited area based on a movable range of the work machine, extract an undetectable area that cannot be detected by the plurality of monitoring apparatus from the set intrusion prohibited area based on the monitoring range information transmitted from the monitoring apparatus, exclude the extracted undetectable area from the intrusion prohibited area, set a supplementary area inside the excluded undetectable area and formed by the perimeter of the monitoring range of the plurality of monitoring apparatuses, set the remaining intrusion prohibited area excluding the undetectable area and the set supplementary area as a new intrusion prohibited area, and upon determining that there is an obstacle in the set new intrusion prohibited area based on the obstacle information transmitted from any of the plurality of monitoring apparatus, calculate an operation limiting command for limiting operation of the work machine and limit the operation of the work machine according to the operation limiting command.

2. The intrusion monitoring control system according to claim 1, wherein the monitoring apparatus includes a positioning apparatus that detects a position and azimuth of the monitoring apparatus, and converts the obstacle information and the monitoring range, on a basis of a position and azimuth of the monitoring apparatus detected by the positioning apparatus, into obstacle information and a monitoring range in a local coordinate system set for a construction site, and transmits, to the controller, the converted monitoring range in the local coordinate system as the monitoring range information, along with the converted obstacle information in the local coordinate system, and wherein the controller is configured to limit the operation of the work machine on a basis of the obstacle information from the monitoring apparatus.

3. A work machine that operates at a construction site, comprising:

a controller that controls operation of the work machine, wherein the controller is configured to:

set an intrusion prohibited area based on a movable range of the work machine, treat a preset monitoring range as monitoring range information, extract an undetectable area that cannot be detected by a plurality of monitoring apparatus from the set intrusion prohibited area based on the monitoring range information received from the plurality of monitoring apparatus, which treat a preset the monitoring range as monitoring range information, and transmit a position of an obstacle detected in the monitoring range as obstacle information, exclude the extracted undetectable area from the intrusion prohibited area, set a supplementary area inside the excluded undetectable area and formed by the perimeter of the monitoring range of the plurality of monitoring devices, set the remaining intrusion prohibited area excluding the undetectable area and the set supplementary area as a new intrusion prohibited area, and upon determining that there is an obstacle in the set new intrusion prohibited area based on the obstacle information received from any of the plurality of monitoring apparatus, calculate an operation limiting command for limiting the operation of the work machine and limit the operation of the work machine according to the operation limiting command.

* * * * *